US005630852A

United States Patent [19]

Placek

[11] Patent Number: 5,630,852

[45] Date of Patent: May 20, 1997

[54] ORGANOPHOSPHORUS ADDITIVES FOR IMPROVED FUEL LUBRICITY

[75] Inventor: Douglas G. Placek, Fairless Hills, Pa.

[73] Assignee: FMC Corporation, Philadelphia, Pa.

[21] Appl. No.: 344,763

[22] Filed: Nov. 23, 1994

[51] Int. Cl.[6] ..... C10L 1/26

[52] U.S. Cl. ..... 44/379; 44/375; 44/382

[58] Field of Search ..... 44/379, 382, 375

[56] References Cited

U.S. PATENT DOCUMENTS

| | | | |
|---|---|---|---|
| 2,695,910 | 11/1954 | Asseff et al. | 44/375 |
| 2,828,195 | 3/1958 | Yust et al. | 44/382 |
| 2,911,431 | 11/1959 | Orloff et al. | 44/382 |
| 3,115,465 | 12/1963 | Orloff et al. | 44/379 |
| 3,376,232 | 4/1968 | Coover, Jr. et al. | 44/382 |
| 3,481,717 | 12/1969 | Voelz et al. | 44/382 |
| 3,481,718 | 12/1969 | Schoen et al. | 44/382 |
| 3,696,036 | 10/1972 | Commichau | 44/376 |
| 4,002,437 | 1/1977 | Broeckx et al. | 44/392 |
| 4,177,768 | 12/1979 | Davis | 44/326 |
| 4,208,190 | 6/1980 | Malec | 44/325 |
| 4,242,099 | 12/1980 | Malec | 44/326 |
| 4,795,479 | 1/1989 | Karol | 44/341 |
| 5,344,468 | 9/1994 | Hanlon et al. | 44/379 |

FOREIGN PATENT DOCUMENTS

| | | |
|---|---|---|
| 634239 | 1/1962 | Canada . |
| 634400 | 1/1962 | Canada . |
| 700076 | 12/1964 | Canada . |
| 0521628A2 | 1/1993 | European Pat. Off. . |
| 842541 | 7/1960 | United Kingdom . |

*Primary Examiner*—Ellen M. McAvoy

*Attorney, Agent, or Firm*—Patrick C. Baker; Robert L. Andersen

[57] ABSTRACT

The lubricity (anti-wear properties) of hydrocarbon fuels, oxygenate fuels or mixtures thereof, particularly diesel or aviation fuels having reduced sulphur and/or aromatic content for compliance with regulatory requirements, is improved by the addition of a phosphorus ester or esters (phosphates and/or phosphites), or a concentrate containing the ester or esters, having a total acid number at least 1.0 mg KOH/g. The additives also improve corrosion inhibition.

21 Claims, No Drawings

ORGANOPHOSPHORUS ADDITIVES FOR IMPROVED FUEL LUBRICITY

This invention relates to fuel compositions having improved lubricity. More specifically it is concerned with diesel and other fuels having lower sulphur and/or aromatic contents which are known to have reduced lubricity and thereby to increase the likelihood of wear and the use of organophosphorus additives to improve the lubricity of such fuels.

The U.S. EPA has mandated a reduction in the sulphur and aromatic content of commercial diesel fuels. Regulatory agencies in other countries have either introduced such a requirement or are contemplating doing so. This regulatory regime causes a problem insofar as the fuel industry recognises that fuels which comply with the regulation will exhibit reduced lubricity. The refining processes needed to produce these fuels require more severe hydrotreatment which removes polar species from the fuel and reduces its lubricity. Lubricity is a measure of the capacity of the fuel to flow through the engine without causing excessive wear. Even marginal changes in lubricity may be significant in increasing wear of fuel pumps, valves and injector nozzles over an extended period of use.

There have been a large number of proposals for fuel additives which exhibit anti-wear properties. U.S. Pat. No. 3,696,036 discloses the addition of tetraoctyl (di-methyl-amino) methylene diphosphonate to fuels as an anti-wear additive. U.S. Pat. No. 4,002,437 discloses diesel fuel compositions comprising a mixture of dimeric and trimeric acids produced by the condensation of unsaturated aliphatic monocarboxylic acids with hydroxyaliphatic monocarboxylic acids, with an amine salt of a oxo-alkyl acid ester of orthophosphoric acid, a demulsifier and a solvent. U.S. Pat. No. 4,177,768 discloses a fuel comprising a monohydroxy alkanol, an ignition accelerator and a wear resisting amount of dimerised unsaturated fatty acid and an ester of a phosphorus acid. U.S. Pat. No. 4,208,190 discloses the use of straight chain primary aliphatic amines as wear inhibitors in fuels based on monohydroxyalkanols. U.S. Pat. No. 4,242,099 discloses the addition of a hydrocarbyl succinic acid or anhydride to fuels based upon monohydroxy alkanols as a wear inhibitor. U.S. Pat. No. 4,795,479 discloses the addition of the reaction product of one molar proportion of a terpene and one molar proportion of 2,5-dimercapto-1,3,4-thiadiazole to a diesel fuel as a wear inhibitor. European Patent Application (EPA) 521628A describes the use of a mixture of a triaryl phosphate and an arylpolyphosphate as a wear inhibitor for use in fuels, lubricants and functional fluids.

It has now been discovered that organophosphorus esters having an acid number of at least 1.0 mg KOH/g are effective as anti-wear additives. Specifically, it has been determined that these esters improve the lubricity of fuels having a reduced sulphur and/or aromatics content. The esters may be added to basestocks to form end product fuels or they may be blended with appropriate amounts of liquid carriers to form concentrates for subsequent addition to basestocks or formulated fuels to produce end product fuels.

The end product fuel compositions of the present invention comprise a hydrocarbon fuel, an oxygenate fuel or mixture thereof, and a minor proportion effective to improve lubricity, of a phosphorus acid ester component having an acid number of at least 1.0 mg KOH/g, the ester component comprising one or more compounds having the general formula I:

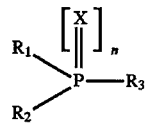

I wherein X represents an oxygen atom O or a sulphur atom S, n is 0 or 1 i.e., X may be present or absent; $R_1$, $R_2$ and $R_3$ which may be the same or different represent a hydrogen atom, a hydroxyl group or a residue —OR where R represents an alkyl, alkoxyalkyl or alkenyl group having from 1 to 18 carbon atoms or an aryl group or alkyl substituted aryl group wherein the alkyl substituent comprises from 1 to 12 carbon atoms with the proviso that at least one of $R_1$, $R_2$ or $R_3$ represents a group —OR.

The phosphorus ester additives may comprise a single ester or a mixture of esters having the above general formula. The additives will comprise at least one ester having the general formula I wherein at least some of the groups $R_1$, $R_2$ and $R_3$ represent hydroxyl groups so that the ester or mixture of esters has an acid number of at least 1.0 mg KOH/g.

In a second aspect of this invention, a method is provided for producing a fuel having improved lubricity properties which comprises adding an effective quantity of an ester or a mixture of esters of general formula I to a suitable fuel, the ester or mixture of esters having a total acid number of at least 1.0 mg KOH/g.

In a third aspect of this invention, a method is provided for the reduction of wear in the fuel system components of an engine which comprises utilising a fuel containing an ester or a mixture of esters having the general formula I, the ester or mixture of esters having a total acid number of at least 1.0 mg KOH/g.

The preferred esters having the formula I for use according to this invention are the phosphate esters, i.e., those compounds having the general formula I above wherein X represents an oxygen atom; n has a value of 1 and $R_1$, $R_2$ and $R_3$ represent hydroxyl groups or a residue OR; at least sufficient of the groups $R_1$, $R_2$ and $R_3$ representing residues OR as will render the ester sufficiently soluble in the fuel to be effective and at least sufficient of the groups $R_1$, $R_2$ and $R_3$ representing hydroxyl groups as will result in the ester or mixture of esters having a total acid number of at least 1.0 mg KOH/g. The preferred esters are those which have a total acid number in the range 10.0 to 300 mg KOH/g. Esters having a higher degree of acidity may be used provided they are sufficiently soluble in the fuel and do not emulsify. In general the acidity will not exceed 600 mg KOH/g.

The effectiveness of the esters, particularly the phosphate esters, as lubricity additives tends to increase with increasing acid number. In addition, the acid phosphate esters are known to be useful as anti-corrosive agents. Their effectiveness as anti-corrosive agents increases with increasing acidity. The addition of an acidic phosphate ester composition to a fuel serves to increase the lubricity of the fuel and to reduce corrosion in storage tanks and transfer lines and to a degree in the engine. The activity of the esters as anti-corrosives may reduce or eliminate the need to add other anti-corrosive agents such as are conventionally used to reduce corrosion of fuel storage tanks.

A preferred group of phosphate esters useful in this invention is that having the general formula I where, in the residue OR, R represents a phenyl group, an alkylated phenyl group wherein the alkyl substituent comprises from 1 to 4 carbon atoms, especially the cresol and the xylenols or an isopropyl phenol or isobutyl phenol which may typically be derived by the alkylation of phenol with propylene, butylene or mixture thereof.

These preferred phosphate esters may readily be produced by the reaction of the appropriate phenol or alkylated phenols with a phosphorylating agent such as phosphorus oxychloride or phosphoric acid. A mixture of phenols and alkylated phenols may be employed in this reaction in which case the ester produced will comprise a mixture of phosphate esters. In a preferred embodiment the phosphorylating agent is reacted with a mixture of phenol and alkylated phenols which has been produced by the alkylation of phenol with an olefin especially with propylene or isobutylene.

A second preferred group of phosphate esters comprises alkyl phosphates which may be produced by the phosphorylation of an aliphatic alcohol. Examples of alcohols which may be used in this reaction include butoxyethanol, 2-ethylhexanol, decanol, isodecanol, octanol, iso-octanol, dodecanol, lauryl alcohol, stearyl alcohol, and any mixtures thereof.

Another group of esters useful in this invention comprises alkyl/aryl phosphates derived by the phosphorylation of a mixture of an alcohol and a phenol. Phosphates derived from the reaction of any of the phenols and alcohols referred to herein are useful in the compositions of this invention.

The reaction between an alcohol and/or phenol and a phosphorylating agent may be controlled so as to produce a product having the desired acid value. The control of the phosphorylation reaction is within the knowledge of one skilled in the art. Alternatively, the ester component of the fuel compositions of this invention may be produced by blending esters of different acid number so as to produce a mixture having an acid number within the preferred range.

Examples of particularly preferred acid phosphate esters which are useful in the compositions of this invention include isopropylphenyl phosphate, 2-ethylhexyl phosphate, n-decyl phosphate, n-octyl phosphate, n-dodecyl phosphate and any mixture of two or more thereof. These esters will normally comprise a mixture of the acidic mono-alkyl or mono-aryl phosphate with the acidic dialkyl or diaryl phosphate and optionally with the neutral trialkyl or triaryl phosphate. These mixtures may be produced using phosphorylation processes of the type described above. The acid number of such a mixture will vary with its composition. Alternatively, the phosphates may be produced by blending one or more acid phosphates with a trialkyl or triaryl phosphate. The acid number of the ester fuel additive composition may also be controlled by the addition of an organic acid which is soluble in the ester.

Another group of esters useful in the compositions of this invention are the phosphites, i.e., those compounds of Formula I wherein n has a value of 0, and $R_1$, $R_2$ and $R_3$ represent hydroxyl groups or a residue OR. Again, at least sufficient of the groups $R_1$, $R_2$ and $R_3$ represent a group —OR as will render the ester oil soluble and at least sufficient of the groups $R_1$, $R_2$ and $R_3$ represent hydroxyl groups as will ensure the ester having a total acid number of at least 0.1 mg KOH/g. The preferred phosphites are those wherein the groups R represent an alkyl group having from 8 to 18 carbon atoms, a phenyl group or an alkyl substituted phenyl group wherein the alkyl substituent comprises from 3 to 12 carbon atoms. Specific examples of phosphite esters which may be useful in the compositions of this invention include trioctyl phosphite, dioctyl phosphite, tri-isodecyl phosphite, di-isodecyl phosphite, trilauryl phosphite, dilauryl phosphite, tristearyl phosphite, distearyl phosphite, triphenyl phosphite, diphenyl phosphite, tris nonylphenyl phosphite, phenyl di-isooctyl phosphite, phenyl di-isodecyl phosphite and any mixtures of two or more thereof, alone or in combination with the phosphate esters described above.

The phosphorus esters are incorporated into the fuel in a quantity which is sufficient to impart the desired lubricity properties. Minor amounts are used, typically less than 10% by weight but more usually in the range 0.0001% to 5.0% by weight of the fuel, preferably in the range 0.001 to 0.05% by weight of the fuel.

The phosphorus ester additives may also be blended with liquid carriers, compatible with the end product fuels, to form concentrates for subsequent addition to fuel basestocks or formulated fuels. Such concentrates may facilitate mixing, blending, pouring or transferring (bulk or line) of the ester additive. Typically, the carriers are organic solvents for the ester additives, such as hydrocarbons (e.g., zylene and toluene), ethers, alcohols or mixtures thereof, or they may be portions of the fuel basestocks or formulated fuels intended as the end products. Addition of the concentrates to basestocks or formulated fuels to form end product fuels may be batchwise, for example from unit containers of concentrates sold at retail or other outlets, or may be added by metering at refineries or fuel distribution sites. Other modes of addition will be evident. The amount of additive in the concentrate may vary, depending on desired concentrate properties such as viscosity. Generally, about 10% to 90% by weight of additive in the carrier medium is suitable, more usually about 20% to 50% by weight.

The end product fuels may be hydrocarbon fuels, oxygenates or mixtures of the two. The hydrocarbon fractions which may be used for the fuel compositions include distillate fuels which boil in the kerosene and gas oil range (165° C. to 565° C.). Typical middle distillate fuels of this kind include road diesel and other diesel fuels with boiling ranges in the range 200° to 370° C. and jet fuels, kerosenes gas oil and cycle oils. Such middle distillate fuels may comprise straight run distillate oils, catalytically or thermally cracked distillate fuel oils or mixtures of straight run distillate fuel oils, napthas and like stock with cracked distillate stocks. These fuels are normally derived from petroleum but they may be derived at least in part from other sources such as shale, tar sands, coal, lignite, biomass and similar sources. The fuels may contain a proportion of oxygenate blending components such as alcohols or ethers including methyl tert. butyl ether (MTBE). The fuels may also wholly comprise oxygenates such as methanol and/or ethanol. The fuels may also be those which have been subjected to conventional treatment processes such as treatment with acid or base, hydrogenation, solvent refining or clay treatment.

The fuels may be used in the operation of a jet engine, a gas turbine or a diesel engine. In preferred embodiments of this invention, the fuel is one which is suitable for use in a diesel engine. The composition of these diesel fuels varies widely with the nature of the crude oil, the refining process, the components with which the raw fuel is blended, and the climate in which the fuel is to be marketed. As noted above, this invention finds particular application in diesel fuels having a reduced sulphur and/or aromatic content which are now being produced in order to comply with regulatory requirements. These fuels typically have sulphur contents below 500 ppm and/or an aromatic content of less than 35% by weight. The composition of the fuel and hence its inherent lubricity may vary according to the severity of the local regulatory regime.

The invention also finds application in aviation fuels such as those commonly used in jet turbine engines. Such fuels have a composition close to that of the diesel fuels having low aromatic and low sulphur content. The addition of the phosphate esters of this invention to these fuels can reduce wear in the engine.

The invention may also find application to "unleaded" or "reformulated" automotive fuels as are now commonly used in piston engines in aircraft and motor vehicles. The addition of phosphorus ester to these fuels may improve engine performance and enable the fuel to be substituted for leaded fuel in uses such as piston engine aircraft where leaded fuel is currently used, provided care is taken to avoid a concentration of phosphorus ester which may poison catalyst in catalytic converters used in some motor vehicles.

The fuels of this invention may also comprise a variety of other additives. These include demulsifying agents, flow improvers, cloud point depressants, waxy anti-settling additives, anti-static additives, anti-oxidants, metal deactivators, anti-foams, dehazer additives, biocides, odor masks, detergent/dispersant additives, dyes, cetane improvers and other lubricity additives. The phosphorus esters of this invention may be combined with any of these additives provided the components of such mixtures are mutually compatible.

The phosphorus ester additives of this invention may be added separately to the fuel or they may be combined with one or more of the additives described to produce an additive formulation which is suitable for addition to a base fuel.

The following non-limiting example illustrates the anti-wear properties of some of the fuel compositions of this invention. Throughout this specification and the claims, unless otherwise indicated, all parts and percentages are by weight and all temperatures are degrees centigrade. Acid numbers are total acid number (TAN) measured pursuant to ASTM D974.

EXAMPLE

A series of esters of phosphorus acids were blended with diesel fuels or hydrocarbon solvents and subjected to one or both of the following test procedures:

Test One:

The U.S. Army Scuffing Load Wear Test (Ball on Cylinder Lubricity Evaluator "BOCLE")

The scuffing BOCLE test utilises the equipment and basic procedures of ASTM D5001 with the following variations:

| Operating Conditions | |
|---|---|
| Fluid Volume | 50 ± 1.0 ml |
| Fluid Temperature | 25 ± 1° C. |
| Conditioned Air* | 50 ± 1% relative humidity at 25 ± 1° C. |
| Fluid pretreatment 0.50 L/min air flowing through and 3.3 L/min over the fluid for 15 min. 8.1 $ft^3$/hr = 3.8 L/min. | |
| Fluid test conditions 3.8 L/min flowing over the fluid. | |
| Applied Load | |
| Break-In Period | 500 grams |
| Incremental-Load Test | 500 to 8000 grams |
| Single-Load Test | To be defined |
| Cylinder Rotational Speed | 525 ± 1 r/min |
| Test Duration | |
| Break-In Period | 30 seconds |
| Scuff Tests | 60 seconds |

*Note: 50% humidity should be achieved using equal volumes of dry and saturated air. Load is increased until scuffing is detected (coefficient of friction is >0.175).

Test Two: Four Ball Wear Test either in ethanol or in fuel (ASTM D4172).

Test Three: Corrosion Inhibition Test (ASTM D665 Rust Test).

The results are presented in the following Table I where "TAN" means total acid number per ASTM D 974. Isopar BOCLE represents tests carried out in a commercially available low sulphur solvent Isopar M. #1D Fuel BOCLE represents results obtained in a winter grade diesel fuel formulation. #2D Fuel BOCLE represents results obtained using a low sulphur low aromatic content diesel fuel formulation. The results on the neutral or near neutral esters H, TEHP and TBEP are presented as comparative examples.

TABLE I

| | | FMC Lubricity Additive Performance | | | | | | | | |
|---|---|---|---|---|---|---|---|---|---|---|
| | | ISOPAR BOCLE | | #1D FUEL BOCLE | | #2D FUEL BOCLE | | ETHANOL 4-BALL scar, mm. | | RUST TEST |
| ADDITIVE | TAN mg KOH/g | 200 PPM | 500 PPM | 50 PPM | 200 PPM | 50 PPM | 100 PPM | 200 PPM | 500 PPM | 200 PPM |
| None (Control) | | 1300 g | | 2000 g | | 1400 | | 0.80 mm | | Severe |
| H | 0.08 | 1300 | 1500 | 2100 | 2300 | | | 0.71 | | Pass |
| Tri(2-ethylhexyl) phosphate (TEHP) | 0.10 | 1700 | 2000 | | 2300 | | | 0.71 | | Pass |
| Mono & di n-decyl acid phosphate | 270 | 4000 | 12000+ | 2500 | 5,600 | | | 0.56 | 0.43 | Pass |
| Mono & di n-octyl acid phosphate | 190 | 3000 | | 2500 | 5600 | | | 0.57 | 0.54 | Pass |
| Mono & di n-octyl acid phosphite | 5.0 | | | | 2400 | | | 0.66 | | Pass |
| Mono & di n-dodecyl acid phosphite | 130 | | | 2600 | 10000+ | | | 0.62 | 0.62 | Pass |
| Tri(butoxyethyl) phosphate (TBEP) | 0.6 | 1600 | 1600 | 2100 | 2400 | | | | | Pass |
| I | 15 | | | 2700 | 3100* | 1700 | 2300 | | | Pass |
| J | 30 | | | 2300 | 2700* | | | | | Pass |
| K | 23 | | | 2400 | 2400* | 1400 | 1600 | | | Pass |

* = test using 100 ppm of additive.

H = mixture of tri(isoprophenyl) phosphate, diphenyl monopropylphenyl phosphate, phenyl dipropylphenyl phosphate and triphenyl phosphate, 8/35/19/31 parts by wt. (±5%).

I = mixture of isopropyl phenyl phosphate and mono/di (n-decyl) acid phosphate, 95/5 parts by wt.

J = mixture of isopropyl phenyl phosphate and mono/di n-decyl acid phosphate, 80/20 parts by wt.

K = mixture of isopropyl phenyl phosphate and mono/di (n-dodecyl) acid phosphite, 95/5 parts by wt.

What is claimed is:

1. An anti-wear fuel composition consisting essentially of a hydrocarbon fuel an oxygenate fuel or mixture thereof, and a minor proportion of a phosphorus acid ester component having a total acid number of from 10 to 300 mg KOH/g, the ester component comprising one or more esters having the general formula I:

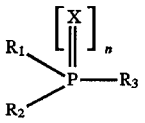

I wherein X represents an oxygen atom O or a sulphur atom S, n has a value of 0 or 1, and $R_1$, $R_2$ and $R_3$, which may be the same or different, represent a hydrogen atom, a hydroxyl group or a residue —OR wherein R represents an alkyl, alkoxyalkyl or alkenyl group having from 1 to 18 carbon atoms or an aryl group or an alkyl substituted aryl group wherein the alkyl substituents comprise from 1 to 12 carbon atoms and at least one of $R_1$, $R_2$ and $R_3$ represents a residue —OR.

2. The fuel composition of claim 1 wherein the phosphorus acid ester component has a total acid number of from 10 to 150 mgKOH/g.

3. The fuel composition of claim 1 wherein the ester component consists wholly or mainly of compounds having the general formula I wherein X represents an oxygen atom and n has a value of 1.

4. The fuel composition of claim 3 wherein $R_1$, $R_2$ and $R_3$ represent a residue —OR or a hydroxyl group.

5. The fuel composition of claim 4 wherein R represents an alkyl group having from 1 to 18 carbon atoms.

6. The fuel composition of claim 5 wherein R represents an alkyl group comprising from 4 to 12 carbon atoms.

7. The fuel composition of claim 5 wherein R represents an alkoxyalkyl group comprising from 1 to 18 carbon atoms.

8. The fuel composition of claim 7 wherein R represents a butoxyethyl group.

9. The fuel composition of claim 3 wherein R represents a phenyl group.

10. The fuel composition of claim 3 wherein R represents an alkyl substituted phenyl group.

11. The fuel composition of claim 10 wherein R represents a cresyl group.

12. The fuel composition of claim 10 wherein R represents a mixture of alkylated phenyl group which have been produced by the alkylation of phenol with isopropylene and/or isobutylene.

13. The fuel composition of claim 1 wherein the ester component consists wholly or mainly of compounds having the general formula I wherein n has a value of 0.

14. The fuel composition of claim 13 wherein $R_1$, $R_2$ and $R_3$ represent a residue —OR or a hydroxyl group.

15. The fuel composition of claim 14 wherein R represents an alkyl group having from 8 to 18 carbon atoms.

16. A method for producing a fuel having improved lubricity properties which comprises adding to the fuel an effective quantity of a phosphorus acid ester component having a total acid number of from 10 to 300 mgKOH/g, the component comprising one or more esters having the general formula I:

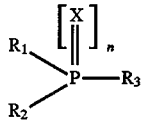

I wherein X represents an oxygen atom O or a sulphur atom S, n has a value of 0 or 1, and $R_1$, $R_2$ and $R_3$, which may be the same or different, represent a hydrogen atom, a hydroxyl group or a residue —OR wherein R represents an alkyl or alkenyl group having from I to 18 carbon atoms or an aryl group or an alkyl substituted aryl group wherein the alkyl substituents comprise from 1 to 12 carbon atoms and at least one of $R_1$, $R_2$ and $R_3$ represents a residue—OR.

17. In a method for the reduction of wear in an engine fuel system, the improvement which comprises utilising as the fuel a composition according to any of claims 1 to 15.

18. A concentrate for addition to a hydrocarbon fuel, an oxygenate fuel or mixture thereof, to improve the anti-wear properties thereof, consisting essentially of a phosphorus ester component having a total acid number of from 10 to 300 mg KOH/g and a liquid carrier compatible with the fuel, the ester component comprising one or more esters having the general formula I:

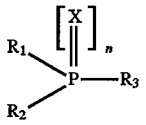

I wherein X represents an oxygen atom O or a sulphur atom S, n has a value of O or 1, and $R_1$, $R_2$, and $R_3$, which may be the same or different, represent a hydrogen atom, a hydroxyl group or a residue —OR wherein R represents an alkyl, alkoxyalkyl or alkenyl group having from 1 to 18 carbon atoms or an aryl group or an alkyl substituted aryl group wherein the alkyl substituents comprise from 1 to 12 carbon atoms and at least one of $R_1$, $R_2$, and $R_3$, represents a residue —OR.

19. The concentrate of claim 18 wherein the amount of ester component is in the range of 10% to 90% by weight of the concentrate.

20. The concentrate of claim 18 wherein the carrier comprises an organic solvent for the ester component, or a portion of the fuel to which the concentrate is to be added.

21. The compositions, methods and concentrates of any one of claims 1–16 and 18–20 wherein the fuel is a diesel fuel.

* * * * *